US010932342B2

(12) United States Patent
Sengodan

(10) Patent No.: US 10,932,342 B2
(45) Date of Patent: Feb. 23, 2021

(54) PERFORMANCE OF LED DRIVE USING ENERGY STORAGE WITH SEGMENT CONTROL

(71) Applicant: Goodrich Corporation, Charlotte, NC (US)

(72) Inventor: Rajkumar Sengodan, Tamilnadu (IN)

(73) Assignee: GOODRICH CORPORATION, Charlotte, NC (US)

( * ) Notice: Subject to any disclaimer, the term of this patent is extended or adjusted under 35 U.S.C. 154(b) by 0 days.

(21) Appl. No.: 16/580,245

(22) Filed: Sep. 24, 2019

(65) Prior Publication Data

US 2021/0014951 A1 Jan. 14, 2021

(30) Foreign Application Priority Data

Jul. 11, 2019 (IN) ..... 201911027866

(51) Int. Cl.

| | |
|---|---|
| ***H05B 37/02*** | (2006.01) |
| ***H05B 45/44*** | (2020.01) |
| ***H05B 45/10*** | (2020.01) |
| *H05B 45/345* | (2020.01) |
| *H05B 45/30* | (2020.01) |

(52) U.S. Cl.

CPC ..... *H05B 45/44* (2020.01); *H05B 45/10* (2020.01); *H05B 45/30* (2020.01); *H05B 45/345* (2020.01)

(58) Field of Classification Search

CPC ..... H05B 45/10; H05B 45/30; H05B 45/345

See application file for complete search history.

(56) References Cited

U.S. PATENT DOCUMENTS

| | | | | |
|---|---|---|---|---|
| 8,680,889 | B2 * | 3/2014 | Leshniak | H05B 45/00 326/121 |
| 9,144,127 | B1 * | 9/2015 | Yu | H05B 45/46 |
| 9,246,403 | B2 * | 1/2016 | Siessegger | H05B 45/10 |
| 9,826,583 | B1 | 11/2017 | Xiong et al. | |
| 9,974,132 | B2 * | 5/2018 | Buthker | H05B 45/48 |

FOREIGN PATENT DOCUMENTS

CN 203368874 U 12/2013

* cited by examiner

*Primary Examiner* — Thuy Vinh Tran
(74) *Attorney, Agent, or Firm* — Cantor Colburn LLP

(57) ABSTRACT

Systems and methods for operating light emitting diodes (LEDs) circuits are provided. Aspects include a plurality of light emitting diodes (LEDs) arranged in a plurality of segments, wherein the plurality of segments comprise a first segment and a second segment, and the plurality of segments are connected in series between a rectified alternating current (AC) power source and ground and a control circuit configured to operate the first bypass switch, the second bypass switch, and the third bypass switch; and wherein the control circuit is further configured to determine a rectified voltage of the rectified AC power source and operate the third switch to turn off when the rectified voltage drops below a first threshold.

13 Claims, 4 Drawing Sheets

PERFORMANCE OF LED DRIVE USING ENERGY STORAGE WITH SEGMENT CONTROL

CROSS-REFERENCE TO RELATED APPLICATIONS

This application claims the benefit of Indian Provisional Application No. 201911027866 filed Jul. 11, 2019, which is incorporated herein by reference in its entirety.

BACKGROUND

The present invention generally relates to light emitting diodes (LEDs), and more specifically, to circuit and method for improved performance of LED drive using energy storage with segment control.

A light-emitting diode (LED) circuit (also referred to as an LED driver) is an electrical circuit used for an LED. The circuit provides sufficient current to light the LED at the required brightness, while also limiting the current to prevent damaging the LED. Typically, LED drivers include a limitation of LEDs turning off relatively at low voltage when utilizing an alternating current LED driver for a larger number of LEDs connected in series which can cause issues in power sensitive applications for LEDs such as LED drivers, displays and low power electronic devices in aircraft systems, automobiles, and consumer electronics.

SUMMARY

Embodiments of the present invention are directed to system. A non-limiting example of the system includes a plurality of light emitting diodes (LEDs) arranged in a plurality of segments, wherein the plurality of segments comprise a first segment and a second segment, and wherein the plurality of segments are connected in series between a rectified alternating current (AC) power source and ground, wherein the first segment comprises a first capacitor arranged in parallel with a first set of LEDs in the first segment and a first bypass switch, wherein the first bypass switch allows current to flow from the rectified AC power source to the first set of LEDs and the first capacitor when the first bypass switch is off; and wherein the first bypass switch allows current to bypass the first set of LEDs and the first capacitor when the first bypass switch is on, wherein the second segment comprises a second capacitor arranged in parallel with a second set of LEDs in the second segment, a third capacitor arranged in parallel with the second set of LEDs in the second segment, a second bypass switch, and a third bypass switch, wherein the second bypass switch allows current to flow from the rectified AC power source to the second set of LEDs and the second capacitor when the second bypass switch is off and wherein the second bypass switch allows current to bypass the second set of LEDs and the second capacitor when the second bypass switch is on, wherein the third bypass switch allows current to flow from the rectified AC power source to the third capacitor when the third bypass switch is off; and wherein the third bypass switch allows current to bypass the third capacitor when the third bypass switch is on, a control circuit configured to operate the first bypass switch, the second bypass switch, and the third bypass switch; and wherein the control circuit is further configured to: determine a rectified voltage of the rectified AC power source and operate the third switch to turn off when the rectified voltage drops below a first threshold.

Embodiments of the present invention are directed to a method for operating an LED circuit. A non-limiting example of the method includes providing a plurality of light emitting diodes (LEDs) arranged in a plurality of segments, wherein the plurality of segments comprise a first segment and a second segment, and wherein the plurality of segments are connected in series between a rectified alternating current (AC) power source and ground. The first segment includes a first capacitor arranged in parallel with a first set of LEDs in the first segment and a first bypass switch, wherein the first bypass switch allows current to flow from the rectified AC power source to the first set of LEDs and the first capacitor when the first bypass switch is off. Also, the first bypass switch allows current to bypass the first set of LEDs and the first capacitor when the first bypass switch is on. The second segment comprises a second capacitor arranged in parallel with a second set of LEDs in the second segment, a third capacitor arranged in parallel with the second set of LEDs in the second segment, a second bypass switch, and a third bypass switch. The second bypass switch allows current to flow from the rectified AC power source to the second set of LEDs and the second capacitor when the second bypass switch is off and the second bypass switch allows current to bypass the second set of LEDs and the second capacitor when the second bypass switch is on. Also, the third bypass switch allows current to flow from the rectified AC power source to the third capacitor when the third bypass switch is off and wherein the third bypass switch allows current to bypass the third capacitor when the third bypass switch is on. The method includes determining, by a controller, a rectified voltage of the rectified AC power source. Also the method includes operating, by the controller, the third switch to turn off when the rectified voltage drops below a first threshold.

Additional technical features and benefits are realized through the techniques of the present invention. Embodiments and aspects of the invention are described in detail herein and are considered a part of the claimed subject matter. For a better understanding, refer to the detailed description and to the drawings.

BRIEF DESCRIPTION OF THE DRAWINGS

The specifics of the exclusive rights described herein are particularly pointed out and distinctly claimed in the claims at the conclusion of the specification. The foregoing and other features and advantages of the embodiments of the invention are apparent from the following detailed description taken in conjunction with the accompanying drawings in which:

Figure 1A:
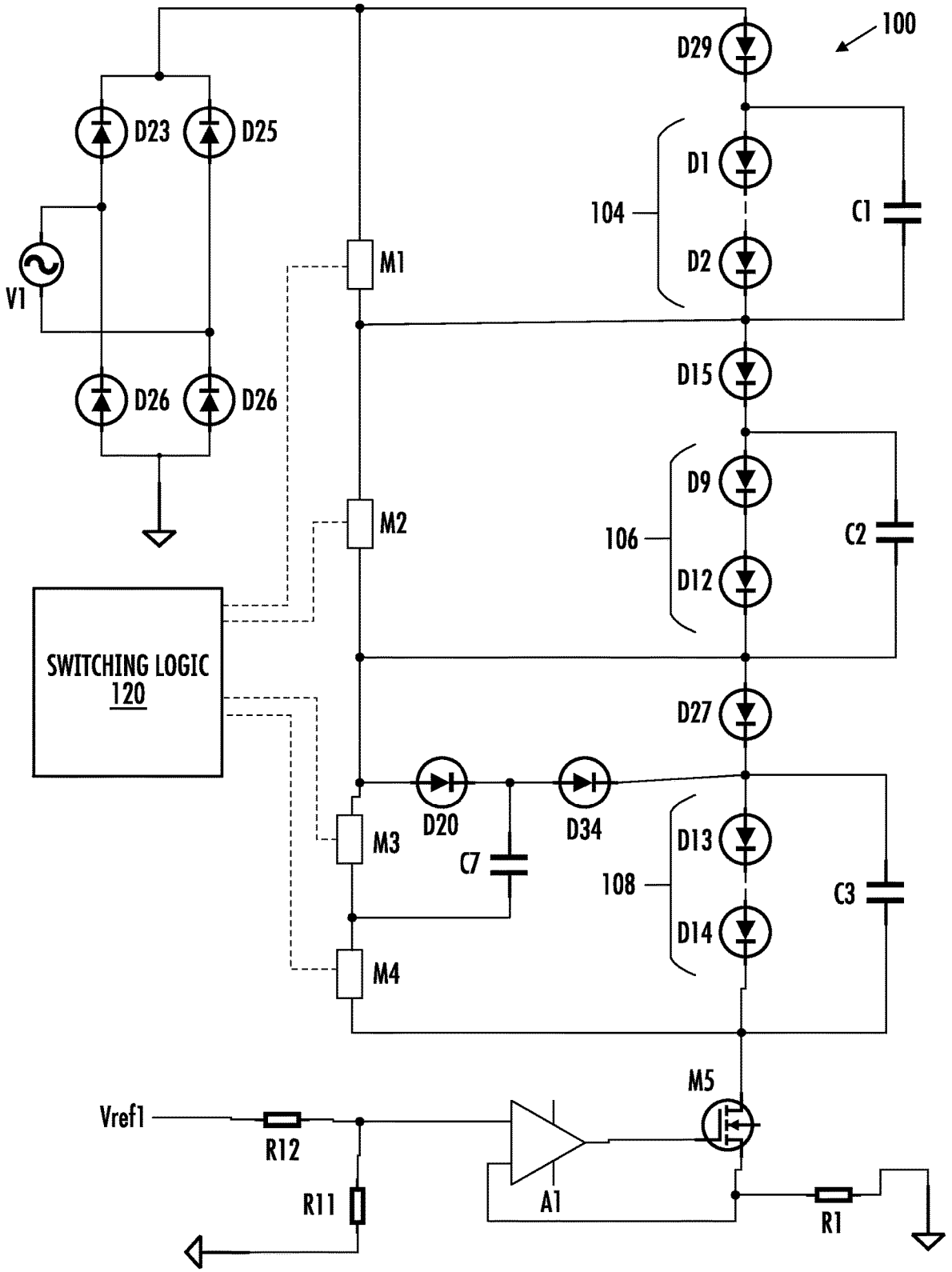
FIG. 1*a* depicts a block diagram of a circuit topology for an LED driver for driving a set of light emitting diodes according to one or more embodiments.

The diagrams depicted herein are illustrative. There can be many variations to the diagram or the operations described therein without departing from the spirit of the invention. For instance, the actions can be performed in a differing order or actions can be added, deleted or modified. Also, the term "coupled" and variations thereof describes having a communications path between two elements and does not imply a direct connection between the elements with no intervening elements/connections between them. All of these variations are considered a part of the specification.

DETAILED DESCRIPTION

Various embodiments of the invention are described herein with reference to the related drawings. Alternative embodiments of the invention can be devised without departing from the scope of this invention. Various connections and positional relationships (e.g., over, below, adjacent, etc.) are set forth between elements in the following description and in the drawings. These connections and/or positional relationships, unless specified otherwise, can be direct or indirect, and the present invention is not intended to be limiting in this respect. Accordingly, a coupling of entities can refer to either a direct or an indirect coupling, and a positional relationship between entities can be a direct or indirect positional relationship. Moreover, the various tasks and process steps described herein can be incorporated into a more comprehensive procedure or process having additional steps or functionality not described in detail herein.

The following definitions and abbreviations are to be used for the interpretation of the claims and the specification. As used herein, the terms "comprises," "comprising," "includes," "including," "has," "having," "contains" or "containing," or any other variation thereof, are intended to cover a non-exclusive inclusion. For example, a composition, a mixture, process, method, article, or apparatus that comprises a list of elements is not necessarily limited to only those elements but can include other elements not expressly listed or inherent to such composition, mixture, process, method, article, or apparatus.

Additionally, the term "exemplary" is used herein to mean "serving as an example, instance or illustration." Any embodiment or design described herein as "exemplary" is not necessarily to be construed as preferred or advantageous over other embodiments or designs. The terms "at least one" and "one or more" may be understood to include any integer number greater than or equal to one, i.e. one, two, three, four, etc. The terms "a plurality" may be understood to include any integer number greater than or equal to two, i.e. two, three, four, five, etc. The term "connection" may include both an indirect "connection" and a direct "connection."

For the sake of brevity, conventional techniques related to making and using aspects of the invention may or may not be described in detail herein. In particular, various aspects of computing systems and specific computer programs to implement the various technical features described herein are well known. Accordingly, in the interest of brevity, many conventional implementation details are only mentioned briefly herein or are omitted entirely without providing the well-known system and/or process details.

Turning now to an overview of technologies that are more specifically relevant to aspects of the invention, LEDs can be utilized in many power sensitive applications such as, for example, displays and low power electronic devices in aircraft lighting systems, aircraft interiors, aircraft display, landing lights, strobe lights for flashing emergency needs, automobiles, and commercial uses. However, as mentioned above, conventional LED include a limitation of LEDs turning off relatively at low voltage when utilizing an alternating current LED driver for a larger number of LEDs connected in series.

The above-described aspects of the invention address the shortcomings of the prior art by providing an LED driving circuit that can be configured in an energy efficient LED application where the power conservation is needed. For driving an array of LEDs, aspects include utilizing a segmented control for varying an input voltage (~115 Vrms). Some embodiments resolve issues related to LEDs turning off relatively at low voltages (~25V). Utilizing a capacitive multiplier configuration, energy is harvested for LED power-on during low input voltage instead of dissipating this energy in a current sense resistor. The LED driver circuit, according to one or more embodiments, can achieve high efficiency and a high optical efficiency by adjusting a LED voltage optimized for the increase or decrease of an alternating current (AC) input by switching/changing the segmented connections of an LED group.

FIG. 1*a* depicts a block diagram of a circuit topology for an LED driver circuit with a charge pump in low voltage LED segments according to one or more embodiments. The circuit topology 100 includes a variety of electronic components that drive a set of LEDs that are divided into through segments 104, 106, 108. While the illustrated example shows only three segments of LED strings, any number of LEDs strings can be utilized with the LED driver circuit 100. In one or more embodiments, an AC voltage input V1 is passed through a full wave rectifier 110 to provide power for the LED driver circuit 100. The LED driver circuit 100 also includes switching control elements M1, M2, M3, M4 that can generate a voltage magnitude required to drive the LED segments 104, 106, 108 from the full wave rectified AC input voltage. The switching period is controlled by switching logic 120. The switching period is controlled in order to regulate voltage across the segments based on the input frequency. NMOS M5 is configured as an active current control and can be driven with a constant voltage for better luminance or connected to rectified voltage from V1 (i.e., VRac) to have an improved power factor. In one or more embodiments, a low voltage charge pump will provide step-up voltage for short periods in each half cycle for the applied input (i.e., at start and end of each half cycle the charge pump configuration is configured to output 2*x* voltage during time period at 20V to 0V and 0V to 20V, for example).

Figure 2:
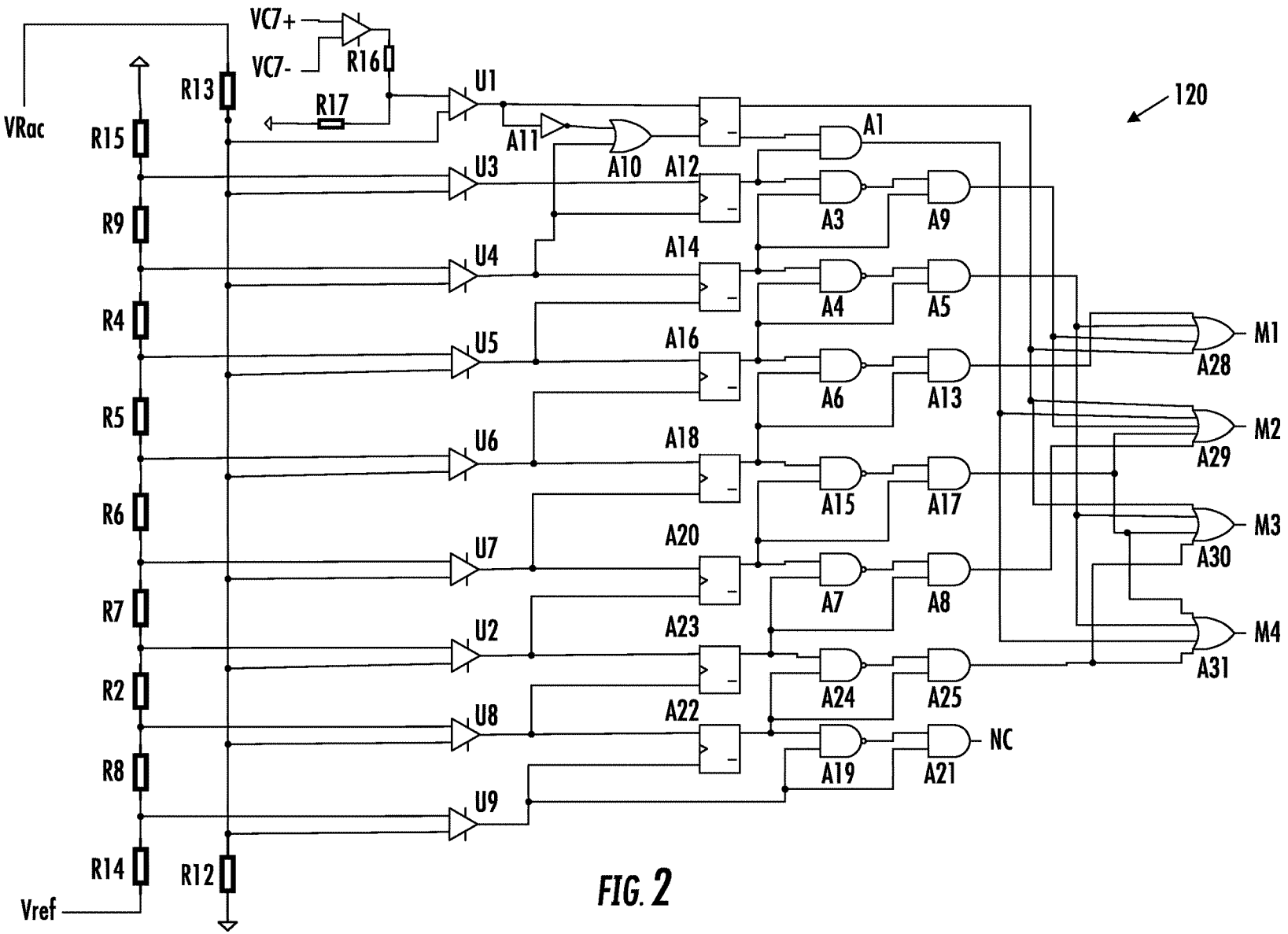
FIG. 2 depicts a block diagram of the switching logic circuit according to one or more embodiments.

In one or more embodiments, to determine the time when the LED segments need to shorted or need to be activated by the switches M1, M2, M3, M4, the switching logic 120 is configured to switch On/Off the respective LED segments 104, 106, 108. The LED segments (104, 106, 108 from FIG. 1*a*) do not need to have the same voltage drop across them (and, hence, do not need to have the same number of LEDs in series). In some embodiments, the switching logic 120 turns on as many LED segments as possible so as to reduce losses in the current source. The switching logic circuit 120 is described with reference to FIG. 2. FIG. 2 depicts a block diagram of the switching logic circuit 120 according to one or more embodiments. The switching logic 120 is configured to activate the switches M1, M2, M3, M4 so that all LEDs appear to have the same brightness and the LED segment voltage closely matches the rectified line voltage. In one or more embodiments, the switching logic 120 is implemented utilizing digital logic components including an array of comparators (U1, U2, U3, U4, U5, U6, U7, U8, and U9), AND gates (A1, A9, A5, A13, A17, A8, A25, and A21), NAND gates (A3, A4, A6, A15, A7, A24, A19), SR flip-flops (A40, A12, A14, A16, A18, A20, A23, A22), and OR gates (A28, A29, A30, A31). A reference voltage Vref can be divided into n-level of voltage references (utilizing resistors R14, R8, R2, R7, R6, R5, R4, R9, R15) that are needed for the comparators inverting terminal to compare with an input rectified AC voltage VRac. The SR flip flops (A40, A12, A14, A16, A18, A20, A23, A22) can be configured with individual stage comparator outputs in order to achieve failsafe working logic and precise switching transition for each threshold voltage levels. The OR gates (A28, A29, A30, A31) will provide O-ring function for the switches M1, M2, M3, M4. The switching logic 120 also includes AND gate A1 which will output a logic HIGH for charging capacitor C7 (if Vcap<VRac) and logic LOW (if Vcap>VRac). Charging and discharging/charge pump logic is implemented using U1, U3, A2 (difference amplifier connected across C7 to measure the voltage, e.g., VC7+, VC7−), A10 (OR gate), A11 (invertor), A40, and A12. The switching logic 120 will ensure to retain floating capacitor voltage to be nearly 15V to 20V and to initiate charge pump action once above the defined charging threshold value.

In one or more embodiments, the switching logic 120 can be based using digital logic circuits or utilizing a microcontroller. This switching logic 120 provides a control voltage for the switches M1, M2, M3, M4 at predefined switching periods. The switching periods are further described in Tables 1 and 2 below. In one or more embodiments, the input voltage can be a variable frequency from 360 Hz to 800 Hz or a fixed frequency (e.g., 400 Hz) which can be generally available from power generators and by default is higher than 200 Hz so as to avoid human eye visual problems of the LED display.

In one or more embodiments, FIG. 1*a* depicts the LED string as three segments 104, 106, 108 and each segment has a different number of LEDs with a breakdown voltage (e.g., ~3.5V) each. The breakdown voltage can be any voltage amount. The LEDs segments are configured whereas segment1 104>segment 2 106>segment3 108. At any condition, the LED breakdown voltage is calculated with respect to each VRac threshold voltage levels and it should be configured in each segment. The input voltage V1 can be, for example, 115 Vrms (162.6 V peak) and the charge pump configuration in low voltage LED group (i.e. segment3 108), where the remaining LED segments 104, 106 can work straight forward with the applied voltage. In some embodiments, the voltage used can be for 230 Vrms, for example. Further, the on/off period of the switching elements M1, M2, M3, M4 can be controlled to achieve a luminance with respect to alternating input voltage.

With reference to Table 1 below, the peak input voltage during the first cycle is described showing the states of the switching elements M1, M2, M3, M4 and the segments 104, 106, 108 of LEDs that are in an ON state. For the VRac=0 to 20 Vpeak, initially, the bypass switches (M1, M2, and M3) are closed and M4 is kept open. When the supply voltage VRac increases from 0V to 20V, the capacitor C7 starts charging as the LED segment 108 has turn on threshold voltage of >20V. The capacitor C7 is chosen to reach complete charging within this time period of charging from 0V to 20V. When utilizing a large capacitor, it may take one or two consecutive half cycles to charge to the desired voltage (~15V to 20V) for the configured constant current M5. Resistors R16, R17 (from FIG. 2) are configured and will determine the charging threshold of the capacitor C7 (i.e., 15V or 16 V, or 20V). Further the comparator U1 can be configured with hysteresis upper threshold of 15V to 20V and lower threshold of 10V to 15V. Thereby, the charging and discharging can be controlled effectively and can be optional based on LED luminance. Further, the charging is accomplished during rising and falling of each half cycle until the capacitor charges to the desired voltage level (Vc7~15V to 20V). Later the charge pump action is configured by the switching logic circuit 120 in successive rising or falling edges of half cycle. It is to be noted that the switching logic comparator U1 will output logic low until C7 charges to the desired voltage. The time constant for determining charging time can be derived from controlled current drive M5, R1 Current drive M5, R1 can be configured as a constant current sink or input VRac dependent current sink. At this stage, considering C7 in charging state the LED groups are not turned on.

In one or more embodiments, the constant current source constituting a power factor may be reduced to expect an increase in the electrical efficiency and light efficiency. Alternatively, to improve power factor Vref1 can be connected to VRac with potential divider network, thereby the current follows the input voltage and behaves similar to resistive load but this reduces light efficiency. The output current has an average current and varies proportional to the full-wave rectified line input voltage VRac most of the time to result in a good power factor.

In one or more embodiments, the switching logic 120 can include resistors R12 and R13 that are used to reduce a full-wave rectified line input voltage VRac (from FIG. 2) to generate the switch control voltage. The capacitors C1, C2, C3 are chosen in such way to provide continuous luminance/flicker free under open/closing of the switches M1, M2, M3 and M4. It may take a few half-cycles of the supply voltage VRac to fully charge. Once the capacitors are charged, then in the steady-state the capacitors (C1, C2 and C3) supply current to the LED segments 104, 106, 108. The isolation diodes (D29, D15, D27, D20 and D34) prevent the capacitors from discharging through the bypass switches.

In one or more embodiments, for VRac=20 to 40 Vpeak, when the supply voltage VRac increases above a first threshold, bypass switch M3, M4 opens. LED segment 108 will receive current through bypass switches M1, M2 and isolation diode D27, LED segment 108 emits light, and capacitor C3 charges. Depending on the size of the capacitors, it may take a few half-cycles of the supply voltage VRac to fully charge. Capacitor C3 will provide the LEDs to emit light continuously when the bypass switches (M1, M2) are closed/opened during successive switching cycle.

In one or more embodiments, for VRac=40 to 60 Vpeak, when the supply voltage VRac increases above a second threshold, bypass switch M2 opens, which resets the SR flip-flop A12 and A40 (from FIG. 2). LED segment 106 will receive current through bypass switches M1, M3 and M4 and isolation diode D15. LED segment 106 emits light, and capacitor C2 provides continuous luminance during switching transition time.

In one or more embodiments, for VRac=60 to 80 Vpeak, when the supply voltage VRac increases above a third threshold, bypass switch M2, M3, M4 opens, which resets SR flip-flop A14 (from FIG. 2). LED segments 106, 108 will receive current through bypass switches M1 and isolation diode D15, D27. LED segments 106, 108 emits light, and capacitor C2, C3 charges and provides continuous luminance during switching transition time.

In one or more embodiments, for VRac=80 to 100 Vpeak, when the supply voltage VRac increases above a fourth threshold, bypass switch M1 opens, which resets the SR flip-flop A16 (from FIG. 2). LED segment 104 will receive current through bypass switches M2, M3, M4 and isolation diode D29. LED segment 104 emits light, and capacitor C1 charges and provides continuous luminance during switching transition time.

In one or more embodiments, for VRac=100 to 120 Vpeak, when the supply voltage VRac increases above a fifth threshold, bypass switch M1, M3, M4 opens, which resets the SR flip-flop A18 (from FIG. 2). LED segments 104, 108 will receive current through bypass switches M2 and isolation diode D29, D27. LED segments 104, 108 emits light, and capacitor C1, C3 charges and provides continuous luminance during switching transition time.

In one or more embodiments, for VRac=120 to 140 Vpeak, when the supply voltage VRac increases above a sixth threshold, bypass switch M1, M2 opens, which resets the SR flip-flop A20 (from FIG. 2). LED segments 104, 106 will receive current through bypass switches M3, M4 and isolation diode D29, D15. LED segments 104, 106 emit light, and capacitor C1, C2 charges and provides continuous luminance during switching transition time.

In one or more embodiments, for VRac=140 to 162.6 Vpeak, when the supply voltage VRac increases above a seventh threshold, bypass switch M1, M2, M3 opens, which resets the SR flip-flop A23 (from FIG. 2). LED segments 104, 106, 108 will receive current through isolation diode D29, D15, D27. LED segments 104, 106, 108 emit light, and capacitor C1, C2, C3 charges and provides continuous luminance during switching transition time.

In one or more embodiments, for VRac=140 to 120 Vpeak, when the supply voltage VRac decreases below seventh threshold, bypass switch M1, M2 opens, which releases the reset of SR flip-flop A20 (from FIG. 2). LED segments 104, 106 will receive current through bypass switches M3, M4 and isolation diode D29, D15. LED segments 104, 106 emit light, and capacitor C1, C2 charges and provides continuous luminance during switching transition time.

In one or more embodiments, for VRac=120 to 100 Vpeak, when the supply voltage VRac decreases below sixth threshold, bypass switch M1, M3, M4 opens, which releases the reset of SR flip-flop A18 (from FIG. 2). LED segments 104, 108 will receive current through bypass switches M2 and isolation diode D29, D27. LED segments 104, 108 LEDs emits light, and capacitor C1, C3 charges and provides continuous luminance during switching transition time.

In one or more embodiments, for VRac=100 to 80 Vpeak, when the supply voltage VRac decreases below fifth threshold, bypass switch M1 opens, which releases the reset of SR flip-flop A16 (from FIG. 2). LED segments 104 will receive current through bypass switches M2, M3, M4 and isolation diode D29. LED segments 104 emits light, and capacitor C1 charges and provides continuous luminance during switching transition time.

In one or more embodiments, for VRac=80 to 60 Vpeak, when the supply voltage VRac decreases below fourth threshold, bypass switch M2, M3, M4 opens, which releases the reset of SR flip-flop A14 (from FIG. 2). LED segments 106, 108 will receive current through bypass switches M1 and isolation diode D15, D27. LED segments 106, 108 emit light, and capacitor C2, C3 charges and provides continuous luminance during switching transition time.

In one or more embodiments, for VRac=60 to 40 Vpeak, when the supply voltage VRac decreases below third threshold, bypass switch M2 opens, which releases the reset of SR flip-flops A12 and A40 (from FIG. 2). LED segments 106 will receive current through bypass switches M1, M3 and M4 and isolation diode D15. LED segments 106 emit light, and capacitor C2 provides continuous luminance during switching transition time.

In one or more embodiments, for VRac=40 to 20 Vpeak, when the supply voltage VRac decreases below second threshold, bypass switch M3, M4 opens. LED segments 108 will receive current through bypass switches M1, M2 and isolation diode D27, and LED segments 108 emits light, and capacitor C3 charges and provides continuous luminance during switching transition time.

In one or more embodiments, for VRac=20 to 0 Vpeak, when the supply voltage VRac decreases below first threshold, bypass switch M4 opens. The capacitor C7 will initiate charge pump action for 20V to 0V as LED segment 108 has turn-on threshold voltage of >20V. As the capacitor is left floating and is already charged to 20V (approx.) in start of the half cycle (t0-t1), the input voltage VRac for time period t14-t15 will boost the C7 voltage in addition to existing 20V. Therefore at instance t14 the output voltage of capacitor is 40V and it reduces to <20V at time t15. LED segment 108 will be OFF below 20V as the drive voltage is insufficient to drive the LEDs. Note that the capacitor is not fully discharged during t14-t15 cycle (i.e., capacitor holds relatively<20V at time t15.) Consider the rising edge (t0-t1) is charging C7 and falling edge (t14-t15) as charge pump with C7 in some embodiments. Alternatively, in one or more embodiments, it can be configured with t14-t15 as charging and consecutive rising edge t15-t16 as charge pump. Once the capacitor is charged to the desired threshold then in each rising/falling edge of half wave the capacitor C7 will be charged then operated as charge pump and is controlled by switching logic 120.

TABLE 1

Switching Sequence- 1st Half Cycle

| Peak Input Voltage | M1 | M2 | M3 | M4 | LED Segments ON |
|---|---|---|---|---|---|
| 0-20 V | ON | ON | OFF | ON | C7-Charging (Initial Half Cycle |
| 20-40 V | ON | ON | OFF | OFF | 108 |
| 40-60 V | ON | OFF | ON | ON | 106 |
| 60-80 V | ON | OFF | OFF | OFF | 106, 108 |
| 80-100 V | OFF | ON | ON | ON | 104 |
| 100-120 V | OFF | ON | OFF | OFF | 104,108 |
| 120-140 V | OFF | OFF | ON | ON | 104,106 |
| 140-161.6 V | OFF | OFF | OFF | OFF | 104, 106, 108 |
| 140-120 V | OFF | OFF | ON | ON | 104,106 |
| 120-100 V | OFF | ON | OFF | OFF | 104,108 |
| 100-80 V | OFF | ON | ON | ON | 104 |
| 80-60 V | ON | OFF | OFF | OFF | 106, 108 |
| 60-40 V | ON | OFF | ON | ON | 106 |
| 40-20 V | ON | ON | OFF | OFF | 108 |
| 20-0 V | ON | ON | ON | OFF | C7-charge pump (108) |

With reference to Table 2 below, the peak input voltage during the second cycle is described showing the states of the switching elements M1, M2, M3, M4 and the segments 104, 106, 108 of LEDs that are in an ONstate. For the VRac=0 to 20 Vpeak (Consecutive half cycle—2nd, 3rd, 4th . . . nth), when the supply voltage VRac increases from 0V to 20V in second cycle, the capacitor C7 will initiate charge pump action for 0V to 20V, time t15-t16. In one or more embodiments, the difference amplifier A2 in the switching logic 120 (from FIG. 2) can sense the voltage across the capacitor and a threshold can be configured by setting up a potential divider network (i.e., R16, R17 from FIG. 2) between the difference amplifier A2 and non-inverting terminal of the comparator U1. This resistor setting will allow to configure capacitor charging threshold and change to charge pump above the threshold. The luminance can be enhanced in each start and end of half cycle with the proposed method. This method will greatly enhance to harvest useful energy in each half cycle.

TABLE 2

| Switching Sequence- 2nd Half Cycle | | | | | |
|---|---|---|---|---|---|
| Peak Input Voltage | M1 | M2 | M3 | M4 | LED Segments ON |
| 0-20 V | ON | ON | ON | OFF | Charging C7 to defined threshold and charge pump action (108) |
| 20-40 V | ON | ON | OFF | OFF | 108 |
| 40-60 V | ON | OFF | ON | ON | 106 |
| 60-80 V | ON | OFF | OFF | OFF | 106, 108 |
| 80-100 V | OFF | ON | ON | ON | 104 |
| 100-120 V | OFF | ON | OFF | OFF | 104,108 |
| 120-140 V | OFF | OFF | ON | ON | 104,106 |
| 140-161.6 V | OFF | OFF | OFF | OFF | 104, 106, 108 |
| 140-120 V | OFF | OFF | ON | ON | 104, 106 |
| 120-100 V | OFF | ON | OFF | OFF | 104, 108 |
| 100-80 V | OFF | ON | ON | ON | 104 |
| 80-60 V | ON | OFF | OFF | OFF | 106, 108 |
| 60-40 V | ON | OFF | ON | ON | 106 |
| 40-20 V | ON | ON | OFF | OFF | 108 |
| 20-0 V | ON | ON | ON | OFF | Charging C7 to defined threshold and charge pump action (108) |

Figure 1B:
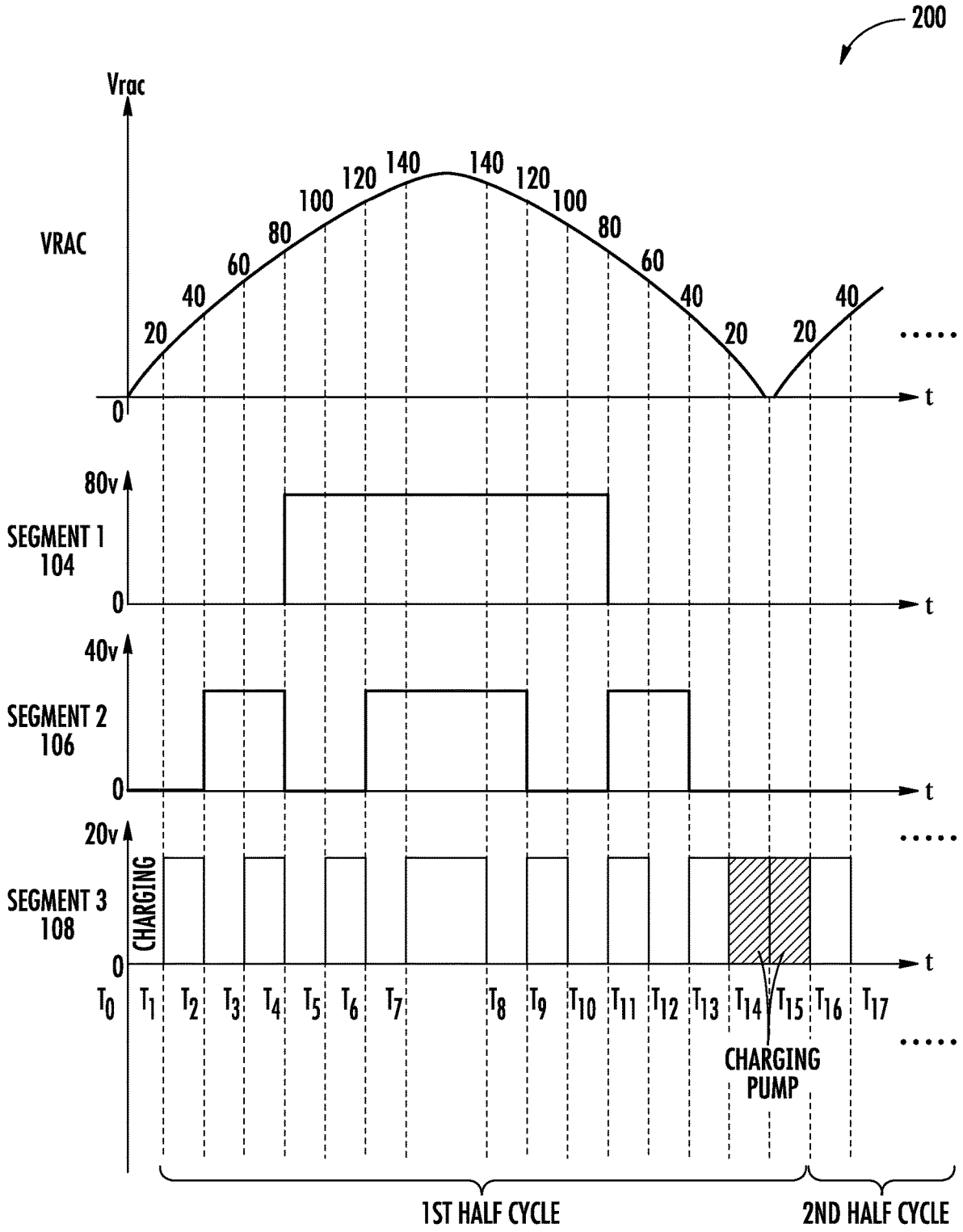
FIG. 1*b* depicts a timing diagram for operation of the LED driver circuit according to one or more embodiments.

Tables 1 and 2 are further illustrated with respect to FIG. 1*b*. FIG. 1*b* depicts a timing diagram for operation of the circuit topology 100. The timing diagram 200 includes example turn-on voltage thresholds for each LED segment 104, 106, 108. In the illustrated example, the turn on voltage for LED segment1 104 is 80V, the turn on voltage for LED segment2 106 is 40V, and the turn on voltage for LED segment3 108 is 20V. In conventional AC power driven LED circuits, the inefficiency exists when the rectified voltage VRac drops below a threshold voltage corresponding to the turn on voltage of the lowest voltage segment (e.g., Segment3 108) which has a 20V turn on voltage. The present circuit topology 100 addresses this inefficiency with the inclusion of the charge pump capacitor C7 which allows the segment3 108 to be turned on when the VRac drops below 20V after the initial charge up cycle. During start and end of each half cycle the voltage 0-20V/20V-0V is utilized for powering up LED string 108 instead of dissipating as heat on the current limiting resistor.

In one or more embodiments, the switching logic 120 or any of the hardware referenced in 100 can be implemented by executable instructions and/or circuitry such as a processing circuit and memory. The processing circuit can be embodied in any type of central processing unit (CPU), including a microprocessor, a digital signal processor (DSP), a microcontroller, an application specific integrated circuit (ASIC), a field programmable gate array (FPGA), or the like. Also, in embodiments, the memory may include random access memory (RAM), read only memory (ROM), or other electronic, optical, magnetic, or any other computer readable medium onto which is stored data and algorithms as executable instructions in a non-transitory form.

Figure 3:
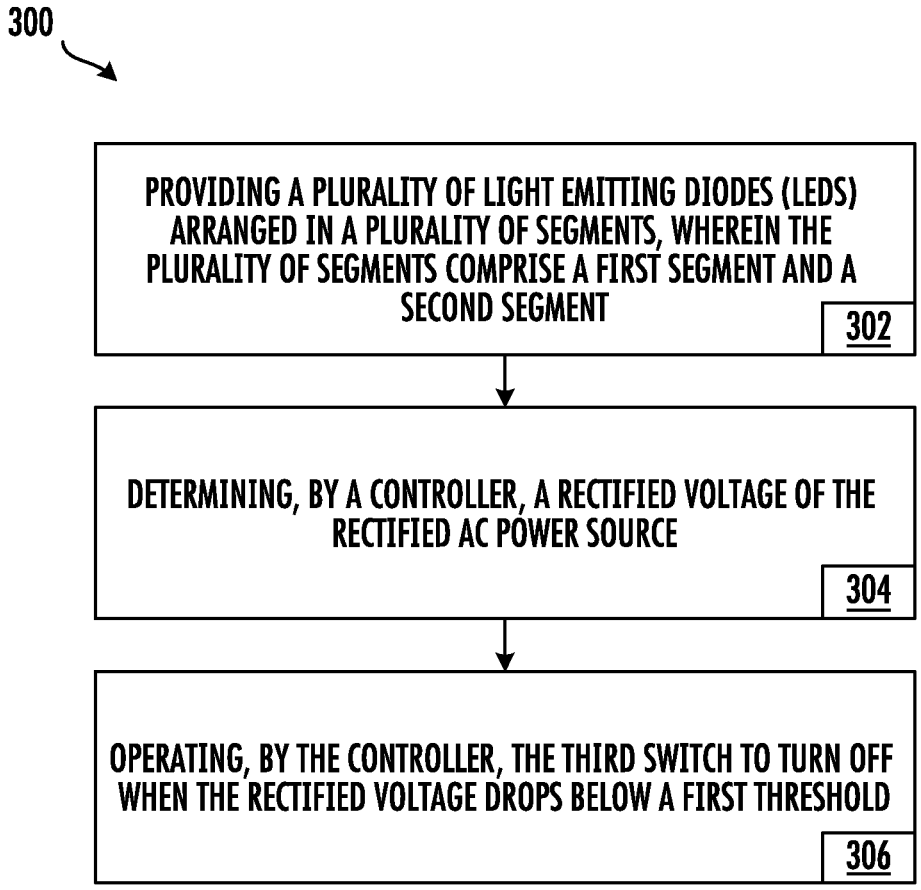
FIG. 3 depicts block diagram of an operating an LED circuit according to one or more embodiments.

FIG. 3 depicts a block diagram of a method for operating an LED circuit according to one or more embodiments. The method 300 includes The method 300 includes providing a plurality of light emitting diodes (LEDs) arranged in a plurality of segments, wherein the plurality of segments comprise a first segment and a second segment, and wherein the plurality of segments are connected in series between a rectified alternating current (AC) power source and ground, as shown at block 302. The first segment includes a first capacitor arranged in parallel with a first set of LEDs in the first segment and a first bypass switch, wherein the first bypass switch allows current to flow from the rectified AC power source to the first set of LEDs and the first capacitor when the first bypass switch is off. Also, the first bypass switch allows current to bypass the first set of LEDs and the first capacitor when the first bypass switch is on. The second segment comprises a second capacitor arranged in parallel with a second set of LEDs in the second segment, a third capacitor arranged in parallel with the second set of LEDs in the second segment, a second bypass switch, and a third bypass switch. The second bypass switch allows current to flow from the rectified AC power source to the second set of LEDs and the second capacitor when the second bypass switch is off and the second bypass switch allows current to bypass the second set of LEDs and the second capacitor when the second bypass switch is on. Also, the third bypass switch allows current to flow from the rectified AC power source to the third capacitor when the third bypass switch is off, and wherein the third bypass switch allows current to bypass the third capacitor when the third bypass switch is on. The method 300 at block 304 includes determining, by a controller, a rectified voltage of the rectified AC power source. And at block 306, the method 300 includes operating, by the controller, the third switch to turn off when the rectified voltage drops below a first threshold.

Additional processes may also be included. It should be understood that the processes depicted in FIG. 3 represent illustrations, and that other processes may be added or existing processes may be removed, modified, or rearranged without departing from the scope and spirit of the present disclosure.

The term "about" is intended to include the degree of error associated with measurement of the particular quantity based upon the equipment available at the time of filing the application. For example, "about" can include a range of 8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A system comprising:

a plurality of light emitting diodes (LEDs) arranged in a plurality of segments, wherein the plurality of segments comprise a first segment and a second segment, and wherein the plurality of segments are connected in series between a rectified alternating current (AC) power source and ground;

wherein the first segment comprises a first capacitor arranged in parallel with a first set of LEDs in the first segment and a first bypass switch, wherein the first bypass switch allows current to flow from the rectified AC power source to the first set of LEDs and the first capacitor when the first bypass switch is off; and wherein the first bypass switch allows current to bypass the first set of LEDs and the first capacitor when the first bypass switch is on;

wherein the second segment comprises a second capacitor arranged in parallel with a second set of LEDs in the second segment, a third capacitor arranged in parallel with the second set of LEDs in the second segment, a second bypass switch, and a third bypass switch;

wherein the second bypass switch allows current to flow from the rectified AC power source to the second set of LEDs and the second capacitor when the second bypass switch is off; and wherein the second bypass switch allows current to bypass the second set of LEDs and the second capacitor when the second bypass switch is on;

wherein the third bypass switch allows current to flow from the rectified AC power source to the third capacitor when the third bypass switch is off; and wherein the third bypass switch allows current to bypass the third capacitor when the third bypass switch is on;

a control circuit configured to operate the first bypass switch, the second bypass switch, and the third bypass switch; and wherein the control circuit is further configured to:

determine a rectified voltage of the rectified AC power source; and operate the third switch to turn off when the rectified voltage drops below a first threshold.

2. The system of claim 1, wherein the first segment further comprises a first isolation diode, wherein the first isolation diode is arranged to prevent a first voltage from the first capacitor through the first bypass switch when the first bypass switch is on.

3. The system of claim 1, wherein the second segment further comprises a second isolation diode, wherein the second isolation diode is arranged to prevent a second voltage from the second capacitor through the second bypass switch when the second bypass switch is on.

4. The system of claim 1, wherein the second segment further comprises a third isolation diode, wherein the third isolation diode is arranged to prevent a third voltage from the third capacitor through the third bypass switch when the third bypass switch is on.

5. The system of claim 1, further comprising:

a constant current source connected is series between the plurality of segments and ground.

6. The system of claim 5, wherein the constant current source comprises an operational amplifier, a switch, and a resistor.

7. The system of claim 6, wherein the switch comprises an n-type metal-oxide semiconductor field effect transistor (MOSFET).

8. The system of claim 1, wherein the first set of LEDs comprises a first number of LEDs;

wherein the second set of LEDs comprises a second number of LEDs; and wherein the first number is larger than the second number.

9. The system of claim 1, further comprises:

a operational amplifier coupled across the third capacitor, wherein an output to the operational amplifier is coupled to at least one input of the control circuit.

10. A method comprising:

providing a plurality of light emitting diodes (LEDs) arranged in a plurality of segments, wherein the plurality of segments comprise a first segment and a second segment, and wherein the plurality of segments are connected in series between a rectified alternating current (AC) power source and ground;

wherein the first segment comprises a first capacitor arranged in parallel with a first set of LEDs in the first segment and a first bypass switch, wherein the first bypass switch allows current to flow from the rectified AC power source to the first set of LEDs and the first capacitor when the first bypass switch is off; and wherein the first bypass switch allows current to bypass the first set of LEDs and the first capacitor when the first bypass switch is on;

wherein the second segment comprises a second capacitor arranged in parallel with a second set of LEDs in the second segment, a third capacitor arranged in parallel with the second set of LEDs in the second segment, a second bypass switch, and a third bypass switch;

wherein the second bypass switch allows current to flow from the rectified AC power source to the second set of LEDs and the second capacitor when the second bypass switch is off; and wherein the second bypass switch allows current to bypass the second set of LEDs and the second capacitor when the second bypass switch is on;

wherein the third bypass switch allows current to flow from the rectified AC power source to the third capacitor when the third bypass switch is off; and wherein the third bypass switch allows current to bypass the third capacitor when the third bypass switch is on;

determining, by a controller, a rectified voltage of the rectified AC power source; and operating, by the controller, the third switch to turn off when the rectified voltage drops below a first threshold.

11. The method of claim 10, wherein the first segment further comprises a first isolation diode, wherein the first isolation diode is arranged to prevent a first voltage from the first capacitor through the first bypass switch when the first bypass switch is on.

12. The method of claim 10, wherein the second segment further comprises a second isolation diode, wherein the second isolation diode is arranged to prevent a second voltage from the second capacitor through the second bypass switch when the second bypass switch is on.

13. The method of claim 10, wherein the second segment further comprises a third isolation diode, wherein the third isolation diode is arranged to prevent a third voltage from the third capacitor through the third bypass switch when the third bypass switch is on.

* * * * *